US011248603B2

(12) United States Patent
Rutter et al.

(10) Patent No.: US 11,248,603 B2
(45) Date of Patent: Feb. 15, 2022

(54) THRUST RUNNER VIBRATION DAMPENING SPRING IN ELECTRICAL SUBMERSIBLE PUMP

(71) Applicant: Baker Hughes Oilfield Operations LLC, Houston, TX (US)

(72) Inventors: Risa Rutter, Claremore, OK (US); Zheng Ye, Claremore, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 448 days.

(21) Appl. No.: 16/410,080

(22) Filed: May 13, 2019

(65) Prior Publication Data

US 2020/0362859 A1 Nov. 19, 2020

(51) Int. Cl.
*F04C 15/00* (2006.01)
*F04C 3/00* (2006.01)
(Continued)

(52) U.S. Cl.
CPC ..... *F04C 15/00* (2013.01); *E21B 43/128* (2013.01); *F04B 47/06* (2013.01); *F04C 3/00* (2013.01); *F04C 13/008* (2013.01); *F04C 15/0061* (2013.01); *F04C 2240/50* (2013.01); *F04D 29/041* (2013.01); *F04D 29/668* (2013.01)

(58) Field of Classification Search
CPC ..... F04C 15/00; F04C 3/00; F04C 13/008; F04C 2240/50; F04C 15/0061; F04C 15/0073; F04C 29/005; F04C 29/007; F04C 29/00; F04C 2240/56; F04C 2240/605; F04B 47/06; E21B 43/128; F04D 29/041; F04D 29/668; F16C 2352/00;
(Continued)

(56) References Cited

U.S. PATENT DOCUMENTS 3,936,247 A * 2/1976 Tschirky ..... E21B 4/003 418/48
4,222,246 A * 9/1980 Rongley ..... F16D 1/0835 464/30
(Continued)

FOREIGN PATENT DOCUMENTS

EP 0816654 A2 1/1998

OTHER PUBLICATIONS

USA Tolerance Rings Catalogue, Pennington, New Jersey, 2013.
International Search Report and Written Opinion of PCT Application No. PCT/US2020/032573 dated Aug. 7, 2020: pp. 1-11.

*Primary Examiner* — Bryan M Lettman
(74) *Attorney, Agent, or Firm* — Bracewell LLP; Keith Derrington

(57) ABSTRACT

A submersible pump assembly has a seal section between the motor and the well fluid pump, the seal section having a housing, a shaft and a thrust bearing unit. The thrust bearing unit includes a thrust runner mounted to the shaft that rotates against a thrust bearing base fixed in the housing. An annular, metal thrust runner wave spring has an inner diameter surface in contact with the shaft and an outer diameter surface in contact with the runner bore. The wave spring has a transverse width between the inner diameter surface and the outer diameter surface that is elastically deflectable, exerting an inward bias force against the shaft and an outward bias force against the runner bore.

12 Claims, 4 Drawing Sheets

(51) Int. Cl.

| | |
|---|---|
| ***E21B 43/12*** | (2006.01) |
| ***F04C 13/00*** | (2006.01) |
| ***F04B 47/06*** | (2006.01) |
| ***F04D 29/041*** | (2006.01) |
| ***F04D 29/66*** | (2006.01) |

(58) Field of Classification Search
CPC ..... F16C 2226/76; F16C 35/02; F16C 27/02; F16D 3/10; F16D 3/12; Y10T 403/7061
See application file for complete search history.

(56) References Cited

U.S. PATENT DOCUMENTS

| | | | | |
|---|---|---|---|---|
| 5,977,677 | A * | 11/1999 | Henry | F16C 39/02 310/90.5 |
| 8,070,426 | B2 | 12/2011 | Brunner et al. | |
| 9,127,683 | B2 | 9/2015 | Knapp | |
| 9,334,865 | B2 | 5/2016 | Johnson et al. | |
| 9,670,779 | B2 * | 6/2017 | Heizinger | F04C 2/103 |
| 9,765,790 | B2 * | 9/2017 | Tanner | F04C 15/008 |
| 2016/0010439 | A1 * | 1/2016 | Parmeter | F04D 29/126 415/104 |
| 2016/0053807 | A1 * | 2/2016 | Maciver | F16C 35/02 384/472 |
| 2018/0313359 | A1 | 10/2018 | Meyer | |

* cited by examiner

THRUST RUNNER VIBRATION DAMPENING SPRING IN ELECTRICAL SUBMERSIBLE PUMP

FIELD OF THE DISCLOSURE

This disclosure relates in general to electrical submersible well pumps (ESP), particularly to a thrust bearing having a thrust runner keyed to the shaft and having a radially compressible vibration dampening ring between the thrust runner and the shaft.

BACKGROUND

Electrical submersible well pumps are often used to pump liquids from hydrocarbon producing wells. A typical ESP includes a pump driven by an electrical motor. The motor is filled with a dielectric lubricant for lubricating motor bearings. A pressure equalizer reduces a differential between the hydrostatic well fluid pressure and the lubricant pressure. The pressure equalizer may be located in a seal section between the motor and the pump.

The well fluid pump generates axial thrust on a drive shaft extending through the seal section. Both down thrust toward the motor and up thrust away from the motor can occur. A thrust bearing unit, usually within the seal section, transfers the down thrust and up thrust to the motor. The thrust bearing unit includes a thrust runner mounted to the shaft for rotation with the shaft. The thrust runner slides on non-rotating down thrust bearing pads during down thrust, transferring the down thrust on the shaft to the housing. The thrust runner slides against non-rotating up thrust bearing pads during up thrust, transferring the up thrust to the housing. The thrust bearing unit may include a screw pump that rotates with the shaft for circulating motor lubricant within the thrust bearing unit. The shaft in the seal section is radially supported at its ends by radial bearings.

The shaft in the seal section may vibrate, particularly at high rotational speeds. Vibration can cause fatigue of components in the seal section. Also, the shaft has a primary mechanical seal at its upper end, and vibration can cause leakage of well fluid into the seal section. The well fluid can migrate through the motor lubricant in the seal section, eventually reaching the motor. Contamination of the motor lubricant in the motor by well fluid can quickly cause failure of the motor.

SUMMARY

A submersible pump assembly (ESP) comprises a well fluid pump, a motor, and a seal section between the motor and the well fluid pump. The seal section has a housing with a longitudinal axis. A shaft extends though the housing on the axis, the shaft being driven by the motor for driving the well fluid pump. A thrust bearing base is mounted in the housing for non-rotation relative to the housing. A thrust runner has a runner bore through which the shaft extends. The thrust runner has an outer diameter spaced radially inward from an inner surface of the housing by an annular clearance. The thrust runner is axially secured to the shaft to prevent axial movement of the thrust runner relative to the shaft. The thrust runner is in rotational, sliding engagement with an upper side of the thrust bearing base. A thrust runner wave spring rotates in unison with the shaft and the thrust runner. The thrust runner wave spring is annular, metal and has an inner diameter surface in contact with the shaft and an outer diameter surface in contact with the runner bore. The thrust runner wave spring has a transverse width between the inner diameter surface and the outer diameter surface that is elastically deflectable, exerting an inward bias force against the shaft and an outward bias force against the runner bore to reduce radial vibration movement of the thrust runner.

An annular thrust runner recess is selectively in the runner bore or on the shaft. The thrust runner wave spring is located in the thrust runner recess. In the embodiment shown, the annular thrust runner recess is on the shaft. The annular thrust runner recess may have an upper shoulder facing a lower shoulder. The thrust runner wave spring has an axial dimension less than a distance from the lower shoulder to the upper shoulder.

In the embodiment shown, an axially extending shaft slot is formed on the shaft and an axially extending runner bore slot is formed in the runner bore. A key inserts into both of the slots to cause rotation of the thrust runner in unison with the shaft. The thrust runner wave spring has two ends spaced apart from each other by a gap through which the key extends.

In one embodiment, an annular thrust runner recess is on the shaft, the thrust runner recess having an upper shoulder facing a lower shoulder and a recess cylindrical surface between the upper and lower shoulders. The thrust runner wave spring is located in the thrust runner recess with an inner diameter surface of the thrust runner wave spring in contact with the recess cylindrical surface. An axially extending shaft slot formed on the shaft extends through the upper shoulder and the lower shoulder but not the recess cylindrical surface. An axially extending runner bore slot is formed in the runner bore. A key fits within both of the slots to cause rotation of the thrust runner in unison with the shaft. The key extends through the shoulders of the recess and has an inward facing surface that is at a radial distance from the axis not less than a radial distance from the axis to the recess cylindrical surface. The thrust runner wave spring has two ends spaced apart from each other by a gap through which the key extends.

DETAILED DESCRIPTION OF THE DISCLOSURE

Figure 1:
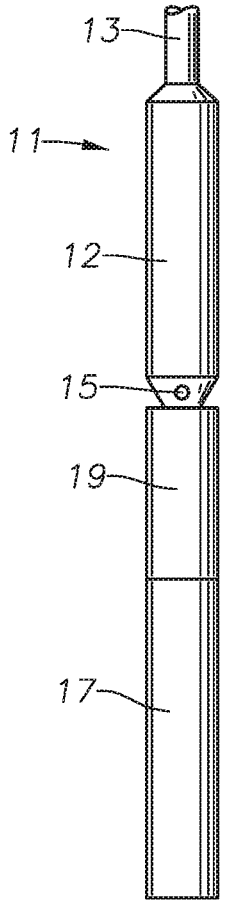
FIG. 1 is a schematic side view of an electrical submersible pump in accordance with this disclosure and installed in a well.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. The terms "upper" and "lower" and the like bare used only for convenience as the well pump may operate in positions other than vertical, including in horizontal sections of a well.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, an electrical well pump assembly (ESP) 11 of a type typically used for oil well pumping operations is illustrated. ESP 11 includes a rotary pump 12 that may be a centrifugal pump having a large number of stages, each of the stages having an impeller and a diffuser. Pump 12 could also be a progressing cavity pump, which has a helical rotor that rotates within an elastomeric double helical stator. Pump 12 may be suspended in a well on a string of production tubing 13. Pump 12 has an intake 15 and discharges into production tubing 13.

ESP 11 also includes an electrical motor 17 for driving pump 12. Motor 17 connects to pump 12 via a seal section 19, which has means for reducing a pressure differential between lubricant within motor 17 and the hydrostatic pressure of well fluid in the well. Intake 15 may be at the lower end of pump 12, in the upper end of seal section 19 or in a separate module. Also, ESP 11 may also include a gas separator, and if so intake 15 would be in the gas separator.

Figure 2:
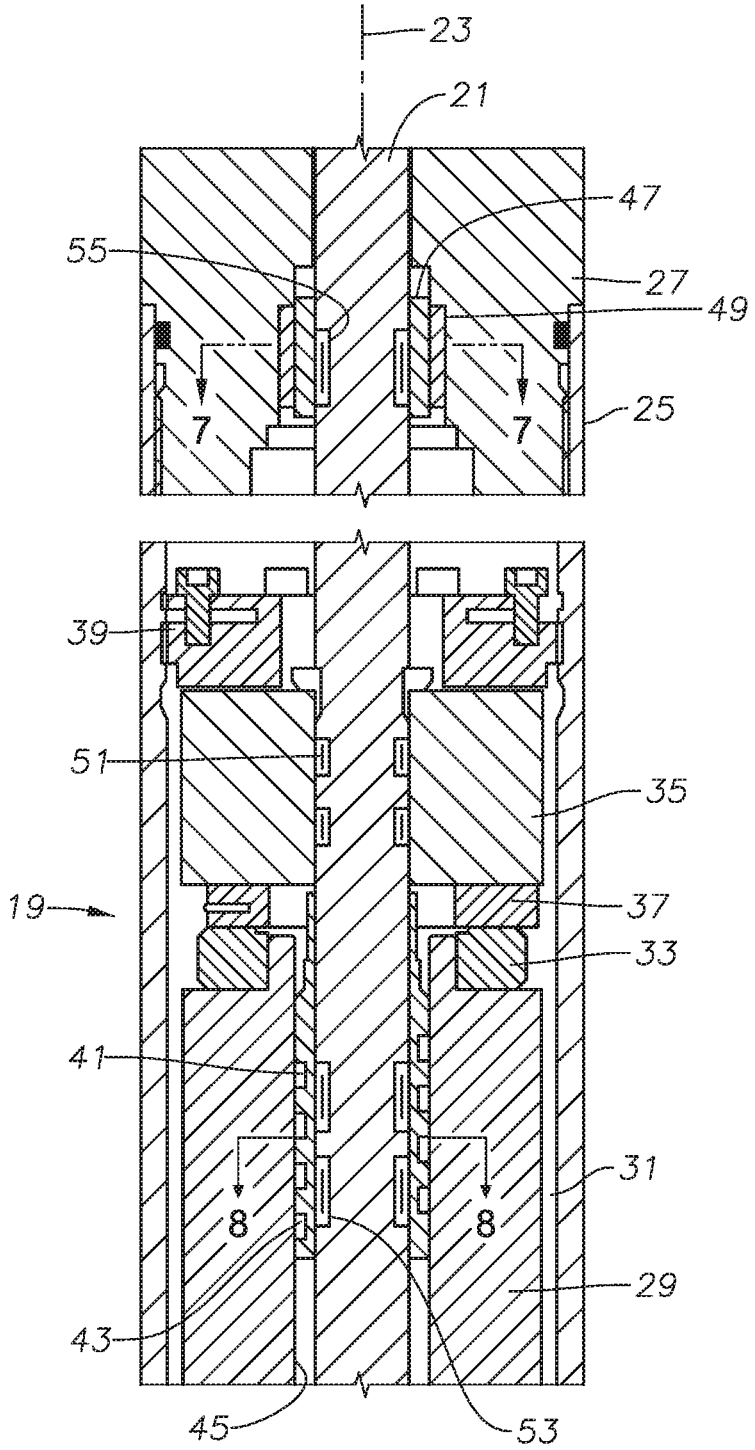
FIG. 2 is an axial sectional and partly schematic view of portions of the seal section of the electrical submersible pump of FIG. 1.

Referring to FIG. 2, seal section 19 has a shaft 21 extending along a longitudinal axis 23 of a cylindrical housing 25. Shaft 21 has a lower splined end (not shown) coupled to a shaft of motor 17 for rotating shaft 21. Shaft 21 has an upper splined end (not shown) coupling to a shaft of pump 12 for driving pump 12. An upper guide or connector 27 secures by threads to housing 25 and has connecting features on its upper end (not shown) for connecting to pump 12. A similar connector or guide (not shown) is on the lower end of seal section 19 for connecting to motor 17.

Seal section 19 has a conventional pressure equalizer that is not shown but will normally comprise an elastomeric bag. Lubricant from motor 17 communicates through passages in seal section 19 with the interior of the elastomeric bag. Well fluid is admitted into the chamber containing the elastomeric bag for imparting hydrostatic well fluid pressure on the elastomeric bag, which in turn applies the hydrostatic pressure to the motor lubricant. Seal section 19 also has a primary seal, normally a mechanical face seal, in an upper portion of upper connector 27 for sealing well fluid from contact with the motor lubricant in the interior of seal section 19.

In this embodiment, seal section 19 has a thrust bearing assembly for transferring down thrust and up thrust imposed on shaft 21 from pump 12 to housing 25. Seal section 19 could include a separate module for the thrust bearing assembly. The thrust bearing assembly may have various configurations and in this example has a non-rotating base including a down thrust transfer member 29 secured to housing 25 for non-rotation relative to housing 25. Thrust transfer member 29 may have a helical passage 31 on its exterior to allow the flow of motor lubricant between thrust transfer member 29 and housing 25. The base also includes a down thrust bearing 33 mounted on the upper side of thrust transfer member 29 for non-rotation relative to thrust transfer member 29.

A thrust runner 35 is rigidly secured to shaft 21 above thrust transfer member 29 for rotation in unison with shaft 21. Thrust runner 35 is a cylindrical member with bearing pads 37 on its lower side that slidingly engage down thrust bearing 33 to transfer down thrust. Thrust runner 35 also transfers any up thrust that may occur on shaft 21 to non-rotating up thrust pads 39. Thrust runner 35 has appreciable mass, being much larger in outer diameter than shaft 21. It also has a significant axial dimension from its lower end to its upper end.

The thrust bearing assembly may also optionally have an inducer or screw pump 41 for circulating motor lubricant. In this embodiment, screw pump 41 has a helical flight 43 on its exterior that is in close reception with down thrust transfer member bore 45. Screw pump 41 is mounted to shaft 21 for rotation therewith.

In addition to a thrust bearing assembly, seal section 19 also has radial bearing assemblies at the upper and lower ends of housing 25 for providing radial support to shaft 21. FIG. 2 shows only the top bearing assembly, but the bottom bearing assembly will have similar components. Those components include a bearing sleeve 47 that rotates with shaft 21. Bearing sleeve 47 has an outer diameter in sliding rotational engagement with a non-rotating bushing 49. Bushing 49 may be press fit into connector 27. Bearing sleeve 47 and bushing 49 may be of carbide material and are immersed in the motor lubricant within seal section 19.

Seal section 19 has one or more thrust runner tolerance rings or wave springs 51 (two shown) between shaft 21 and thrust runner 35. Seal section 19 may also have one or more screw pump tolerance rings or wave springs 53 (two shown) between shaft 21 and screw pump 41. In addition, seal section 19 may have a radial bearing tolerance ring or wave spring 55 between shaft 21 and bearing sleeve 47. The lower radial bearing (not shown) may also have a tolerance ring or wave spring. The various wave springs 51, 53 and 55 reduce vibration of shaft 21, which might occur particularly at high rotational speeds.

Figure 3:
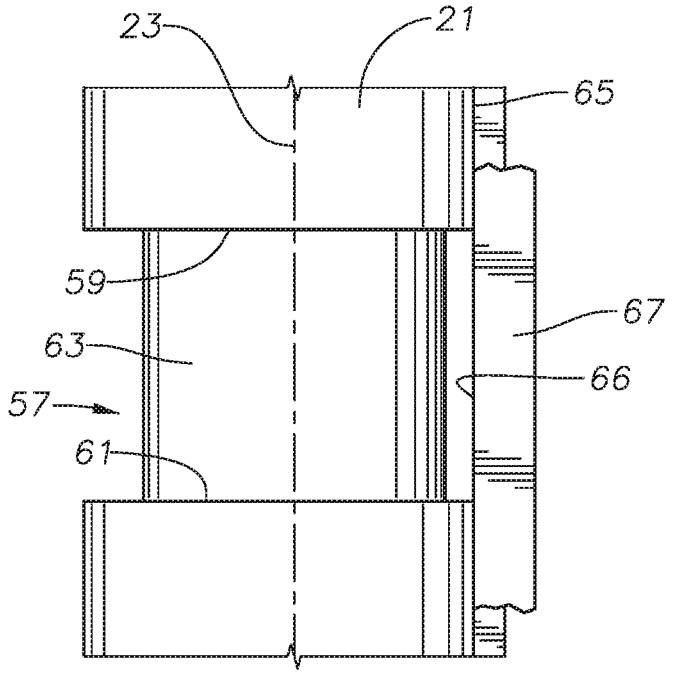
FIG. 3 is a side view of a portion of the shaft and key of the seal section of FIG. 2, shown removed the seal section.

Wave springs 51, 53 and 55 are located in annular recesses, and in this embodiment, all of the recesses are selectively located on shaft 21. FIG. 3 shows a portion of shaft 21 that has an annular recess 57 for receiving one of the shaft runner wave springs 51; the other recesses may be identical. Upper and lower shoulders 59, 61 define the upper and lower ends of annular recess 57. Upper shoulder 59 faces and may be parallel to lower shoulder 61. Upper and lower shoulders 59, 61 define a recess cylindrical surface 63 that has a smaller outer diameter than the outer diameter of shaft 21.

Shaft 21 also has a keyway groove or shaft slot 65 extending most of its length and parallel with axis 23. In this embodiment, shaft slot 65 has a radial depth no greater than the radial width of shoulders 57, 59, thus it does not extend through recess cylindrical surface 63. Shaft slot 65 does extend through upper and lower shoulders 59, 61.

A portion of a key 67 extends through shaft slot 65 above and below shoulders 59, 61 and alongside recess cylindrical surface 63. N Key 67 has an inward facing side 66 that is illustrated as being spaced radially outward a slight distance from recess cylindrical surface 63, but it could touch recess cylindrical surface 63. The radial distance from axis 23 to key inward facing side 66 is not less than the radial distance from axis 23 to recess cylindrical surface 63 in this example.

Figure 5:
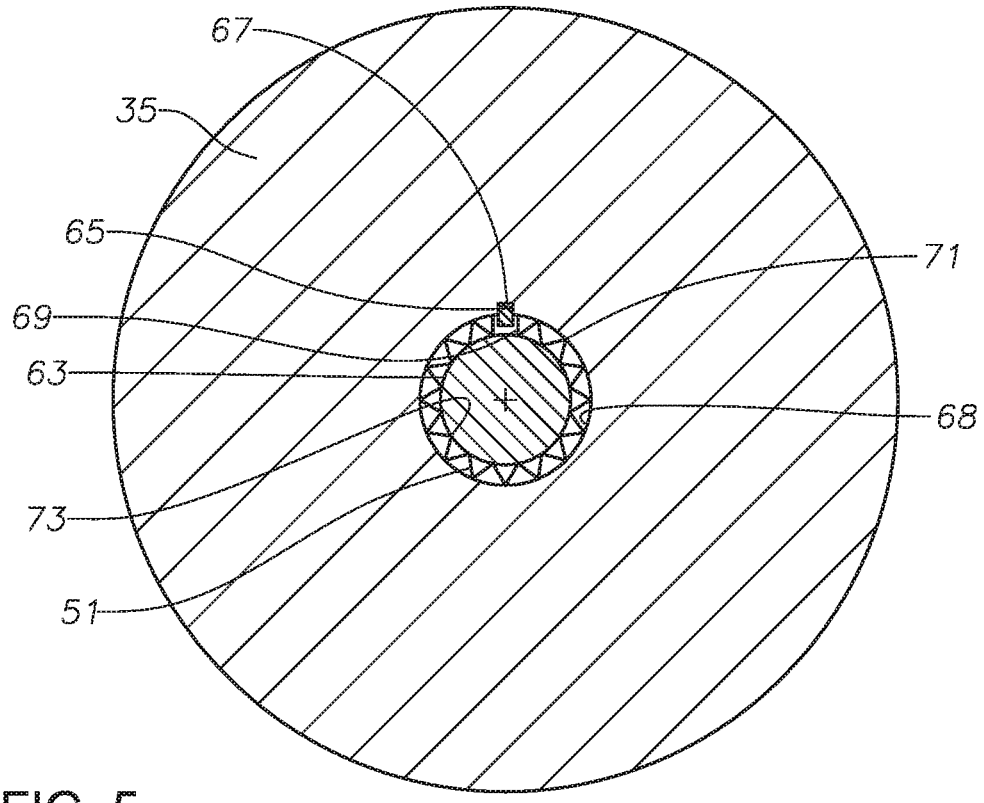
FIG. 5 is a sectional view of the thrust runner of FIG. 4 taken along the line 5-5 of FIG. 4.

FIG. 5, which is a transverse sectional view through thrust runner 35, illustrates key 67 installed within keyway slot 65 and fitting within a mating keyway slot in runner bore 68 of thrust runner 35. Key 67 imparts rotation of shaft 21 to thrust runner 35. The same key 67 may be used to impart rotation to screw pump 41 and bearing sleeve 47 (FIG. 2). Runner bore 68 does not have any recesses, rather has the same inner diameter from the upper side of thrust runner 35 to the lower side of thrust runner 35.

FIG. 5 shows thrust runner wave spring 51 installed in one of the thrust runner recesses 57 surrounded by thrust runner bore 68. Thrust runner wave spring 51 is resilient and in frictional engagement with thrust runner bore 68 and with one of the thrust runner recesses 57. Thrust runner way spring 51 is split, having two ends 69 that are separated from each other by a gap once installed in recess 57. The gap between ends 69 is large enough for the passage of key 67, which causes thrust runner wave spring 51 to rotate in unison with shaft 21. Thrust runner wave spring 51 has outward protruding indentations 71 that exert an outward bias force against thrust runner bore 68. Thrust runner wave spring 51 has inward protruding indentations 73 that exert an inward bias force against recess cylindrical surface 63.

Prior to installation, thrust runner wave spring 51 has a radial or transverse width from its circumscribed outer diameter at outward protruding indentations 71 to its circumscribed inner diameter at inward protruding indentations 73 that is greater than the radial distance from recess cylindrical surface 63 (FIG. 3) to thrust runner bore 68. The resiliency of thrust runner wave spring 51 and the split at ends 69 enable it to be resiliently expanded over shaft 21 and snapped into recess 57. The resiliency also deflects the radial width of thrust runner wave spring 51, causing it to fit tightly between recess cylindrical surface 63 and thrust runner bore 68. The deflection is elastic, less than the yield strength of the material of thrust runner wave spring 51.

Figure 4:
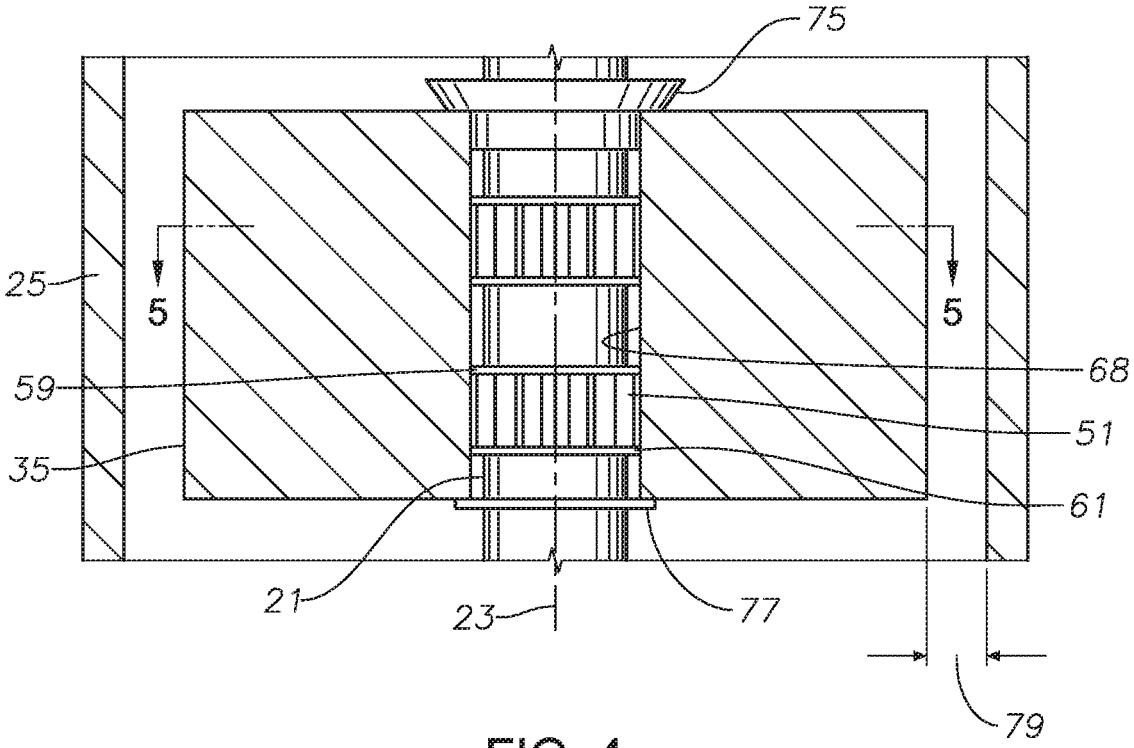
FIG. 4 is an enlarged sectional view illustrating the thrust runner of the seal section of FIG. 2.

As shown in FIG. 4, each wave spring 51 has an axial dimension that is only slightly less than the axial distance from upper shoulder 59 to lower shoulder 61 and considerably less than the axial dimension of thrust runner 35 from its lower end to its upper end. FIG. 4 also illustrates in exaggerated form an annular clearance that exists between the outer diameter of shaft 21 and the inner diameter of bore 68. A clearance is necessary in order to slide thrust runner 35 over shaft 21 during assembly, but it may be only a few thousandths of an inch.

Thrust runner 35 is axially secured to shaft 21 so as to prevent any axial movement of thrust runner 35 on shaft 21. In this example, a multi-piece upper retainer 75 wedges between shaft 21 and thrust runner bore 68. A retainer ring 77, which may be a snap ring, secures to shaft 21 at the lower end of thrust runner 35.

Figure 6:
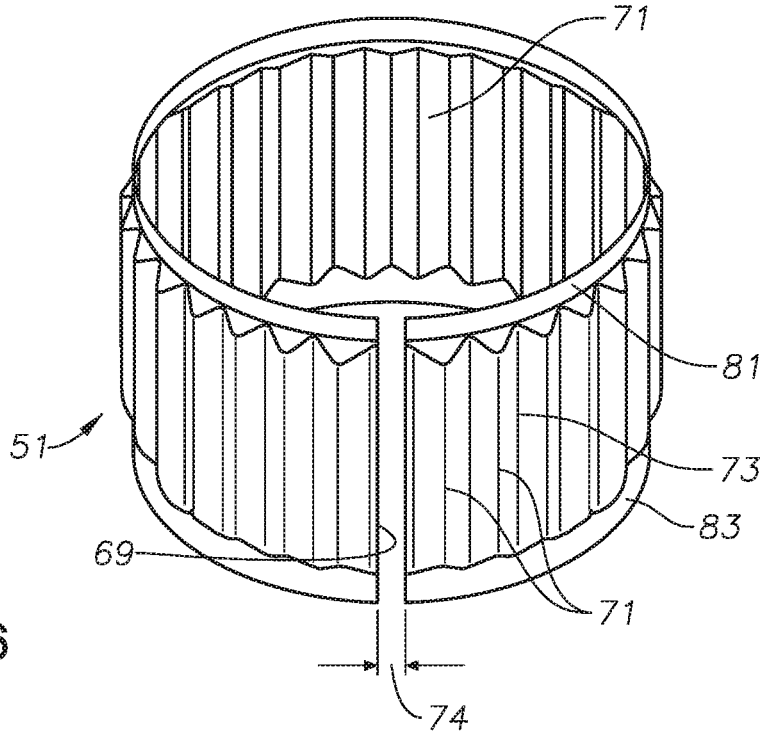
FIG. 6 is a perspective view of the dampening spring shown in FIG. 5 between the shaft and the bore of the thrust runner, the dampening spring being removed from the shaft and thrust runner.

Referring to FIG. 6, thrust runner wave spring 51 is formed of a metal, such as a spring steel. One example of a suitable metal is Hastelloy. Wave spring 51 is a curved strip that is formed into a partially cylindrical shape with an end gap 74 between its ends 69. After installation in thrust runner bore 68 (FIG. 5), end gap 74 is slightly greater than the width of key 67 (FIG. 5). In the example shown, thrust runner wave spring 51 has a circumferentially extending upper band 81 formed on its upper side and a circumferentially extending lower band 83 formed on its lower side.

Outward-protruding waves or indentations 71 are permanently formed in thrust runner wave spring 51, creating convex shapes extending around wave spring 51. Outward-protruding indentations 71 extend from upper band 81 to lower band 83 and are parallel with axis 23 (FIG. 4). Each indentation 71 is elongated, having a length greater than its width. Each inward-protruding wave or indentation 73 is located between two of the outward-protruding indentation 71, creating concave shapes on the exterior of thrust runner wave spring 51. Inward-protruding indentations 73 are identical to outward-protruding indentations 71 in length and width. Each inward-protruding indentation 73 protrudes radially inward from upper and lower bands 81, 83 the same radial distance as each outward-protruding indentation 71. When viewed in cross-section, as in FIG. 5, outward and inward protruding indentations 71, 73 define a sinusoidal configuration.

Figure 7:
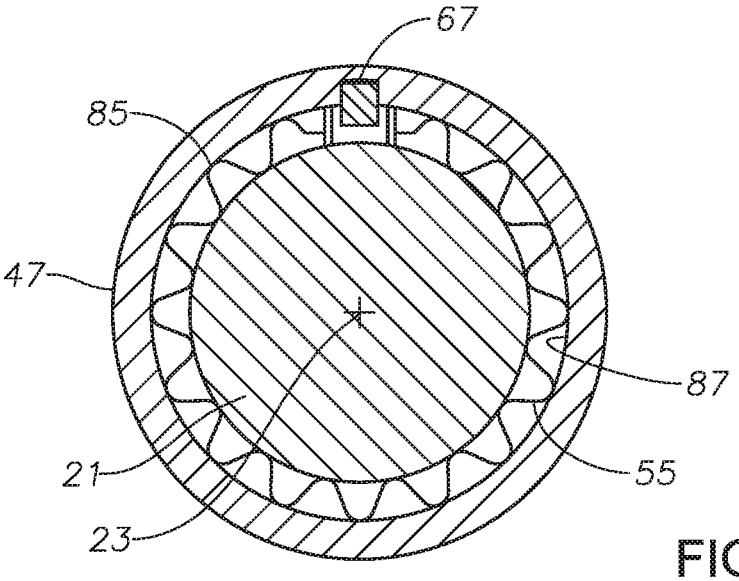
FIG. 7 is a sectional view of a radial bearing in the seal section, taken along the line 7-7 of FIG. 3 and shown removed from the seal section.

Referring to FIG. 7, top bearing wave spring 55 and its installation may be identical to thrust runner wave springs 51 and their installations. Top bearing wave spring 55 fits tightly between a shaft recess 85 and bearing sleeve bore 87 in the same manner as thrust runner wave springs 51. Key 67 engages mating slots in shaft 21 and bearing sleeve bore 87, causing bearing sleeve 47 and bearing sleeve wave spring 55 to rotate with shaft 21. The ends of bearing sleeve wave spring 55 are on opposite sides of key 67 in the same manner as described above.

Figure 8:
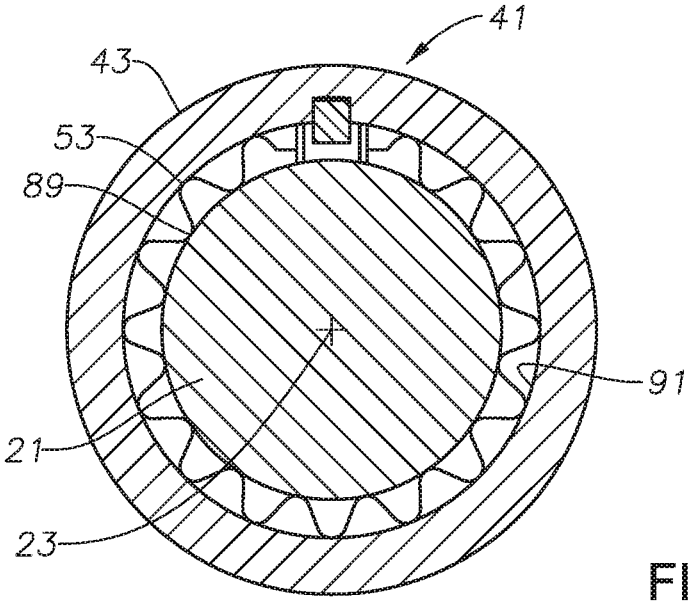
FIG. 8 is a sectional view of a screw pump in the seal section, taken along the line 8-8 of FIG. 2 and shown removed from the seal section.

Referring to FIG. 8, each screw pump wave spring 53 (two shown in FIG. 2) and its installation may be identical to each thrust runner wave spring 51 and its installation. Each fits tightly between a shaft recess 89 and screw pump bore 91 in the same manner as thrust runner wave springs 51. Key 67 engages mating slots in shaft 21 and screw pump bore 91, causing screw pump 41 and screw pump wave spring 53 to rotate with shaft 21. The ends of screw pump wave spring 53 are on opposite sides of key 67 in the same manner as described above.

In operation, motor 17 and portions of seal section 19 are filled with a dielectric lubricant and assembled with pump 12 to form ESP 11. An operator runs ESP 11 into a well to pump well fluid. Supplying power to the motor 17 rotates shaft 21. The various wave springs 51, 53 and 55 tend to reduce vibration of shaft 21, particularly a high speeds.

The present invention described herein, therefore, is well adapted to carry out the objects and attain the ends and advantages mentioned, as well as others inherent therein. While only one embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A submersible pump assembly (ESP), comprising:

a well fluid pump;

a motor;

a seal section between the motor and the well fluid pump, the seal section comprising:

a housing having a longitudinal axis;

a shaft extending though the housing on the axis, the shaft being driven by the motor for driving the well fluid pump;

a down thrust transfer member mounted in the housing for non-rotation relative to the housing;

a thrust runner having a runner bore through which the shaft extends, the thrust runner having an outer diameter spaced radially inward from an inner surface of the housing by an annular clearance, the thrust runner being secured to the shaft to prevent axial movement of the thrust runner relative to the shaft, the thrust runner being in rotational, sliding engagement with an upper side of the thrust bearing base;

a thrust runner wave spring that rotates in unison with the shaft and the thrust runner, the thrust runner wave spring being annular, metal and having an inner diameter surface in contact with the shaft and an outer diameter surface in contact with the runner bore;

the thrust runner wave spring having a transverse width between the inner diameter surface and the outer diameter surface that is elastically deflectable, exerting an inward bias force against the shaft and an outward bias force against the runner bore to reduce radial vibration movement of the thrust runner;

an annular thrust runner recess on the shaft, the thrust runner recess having an upper shoulder facing a lower shoulder and a recess cylindrical surface between the upper and lower shoulders; and wherein the thrust runner wave spring is located in the thrust runner recess with an inner diameter surface of the thrust runner wave spring in contact with the recess cylindrical surface;

an axially extending shaft slot formed on the shaft that extends through the upper shoulder and the lower shoulder but not the recess cylindrical surface;

an axially extending runner bore slot formed in the runner bore;

a key that fits within both of the slots to cause rotation of the thrust runner in unison with the shaft, the key extending through the shoulders of the recess, the key having an inward facing surface that is at a radial distance from the axis not less than a radial distance from the axis to the recess cylindrical surface; and wherein the thrust runner wave spring has two ends spaced apart from each other by a gap through which the key extends.

2. The ESP according to claim 1, further comprising:

the annular thrust runner recess on the shaft and the upper shoulder facing the lower shoulder; and wherein the thrust runner wave spring is located in the thrust runner recess and has an axial dimension less than a distance from the lower shoulder to the upper shoulder.

3. A submersible pump assembly (ESP), comprising:

a well fluid pump;

a motor;

a seal section between the motor and the well fluid pump, the seal section comprising:

a housing having a longitudinal axis;

a shaft extending though the housing on the axis, the shaft being driven by the motor for driving the well fluid pump;

a non-rotating down thrust transfer member having a base bore through which the shaft extends;

a thrust runner having a runner bore through which the shaft extends, the thrust runner having an outer diameter spaced radially inward from an inner surface of the housing by an annular clearance, the thrust runner being axially secured to the shaft to prevent axial movement of the thrust runner relative to the shaft, the thrust runner being in rotational, sliding engagement with an upper side of the thrust bearing base;

a key engaging a runner bore slot in the runner bore and a shaft slot on the shaft for causing the thrust runner to rotate with the shaft;

at least one thrust runner wave spring, the thrust runner wave spring being annular, metal and having an inner diameter surface in contact with the shaft and an diameter surface in contact with the runner bore, the thrust runner wave spring having a split through which the key extends, causing the thrust runner wave spring to rotate in unison with the shaft, the thrust runner wave spring having a radial width between the inner diameter surface and the outer diameter surface of the thrust runner wave spring that is elastically deflected between the shaft and the thrust runner bore, exerting an inward bias force against the shaft and an outward bias force against the thrust runner to reduce radial vibration movement of the thrust runner;

an annular thrust runner recess on the shaft, defining an upper shoulder facing a lower shoulder and a recess cylindrical surface between the upper and lower shoulders; and wherein the thrust runner wave spring is located in the thrust runner recess, with the inner diameter surface of the thrust runner wave spring in contact with the recess cylindrical surface;

the shaft slot extends through the upper shoulder and the lower shoulder but not on the recess cylindrical surface; and the key extends through the shoulders of the recess and has an inner side that is at least as far from the axis than the recess cylindrical surface.

4. The ESP according to claim 3, further comprising:

the annular thrust runner recess on the shaft, defining the upper shoulder facing the lower shoulder; and wherein the thrust runner wave spring is located in the thrust runner recess and has an axial dimension less than a distance from the lower shoulder to the upper shoulder.

5. The ESP according to claim 3, wherein:

the at least one thrust runner wave spring comprises two of the thrust runner wave springs, each having an inner diameter surface in contact with the shaft and an outer diameter surface in contact with the runner bore.

6. The ESP according to claim 3, further comprising:

a threaded connector secured to one end of the housing for connecting one end of the seal section into the ESP, the connector having a connector bore through which the shaft extends;

a bearing bushing non-rotatably and rigidly mounted in the connector bore;

a sleeve mounted to the shaft for rotation therewith, the sleeve having an outer diameter in sliding engagement with the bearing bushing; and an annular, metal, bearing wave spring having an inner diameter surface in contact with the shaft and an outer diameter surface in contact with the sleeve, the bearing wave spring being rotatable in unison with the shaft and the sleeve, the bearing wave spring having a radial width between the inner diameter surface and the outer diameter surface of the bearing wave spring that is elastically deflected between the shaft and the sleeve, exerting an inward bias force against the shaft and an outward bias force against the sleeve to reduce radial vibration movement of the shaft.

7. The ESP according to claim 6, further comprising:

an annular bearing recess on the shaft; and wherein the bearing wave spring is located in the bearing recess.

8. The ESP according to claim 3, further comprising:

a screw pump having a screw pump bore through which the shaft extends, the screw pump being mounted to the shaft for rotation therewith in the base bore to pump motor lubricant through a base bore annulus between the shaft and the base bore; and an annular, metal, screw pump wave spring having an inner diameter surface in contact with the shaft and an diameter surface in contact with the screw pump bore, the screw pump wave spring being rotatable in unison with the shaft and the screw pump, the screw pump wave spring having a radial width between the inner diameter surface and the outer diameter surface of the screw pump wave spring that is elastically deflected between the shaft and the base bore, exerting an inward bias force against the shaft and an outward bias force against the screw pump to reduce radial vibration movement of the shaft.

9. The ESP according to claim 8, further comprising:

a screw pump recess on the shaft; and wherein the screw pump wave spring is located in the screw pump recess.

10. A submersible pump assembly (ESP), comprising:

a well fluid pump;

a motor;

a seal section between the motor and the well fluid pump, the seal section comprising:

a housing having a longitudinal axis;

a shaft extending though the housing on the axis, the shaft being driven by the motor for driving the well fluid pump;

a down thrust transfer member having a base bore through which the shaft extends, the down thrust transfer member being mounted in the housing for non-rotation relative to the housing;

a thrust runner having a runner bore through which the shaft extends, the thrust runner having an outer diameter spaced radially inward from an inner surface of the housing by an annular clearance, the thrust runner being axially secured to the shaft to prevent axial movement of the thrust runner relative to the shaft and having a lower side in sliding, rotational engagement with the thrust bearing base;

an annular first recess on the shaft, the first recess having upper and lower shoulders facing and parallel to each other, the upper and lower shoulders being joined by an outward-facing cylindrical surface;

a runner bore keyway slot extending axially within the runner bore;

a shaft keyway slot on the shaft, the shaft keyway slot extending through the upper and lower shoulders of the recess;

a key engaging the runner bore keyway slot and the shaft keyway slot for causing the thrust runner to rotate with the shaft, the key extending through the first recess;

a thrust runner wave spring, the thrust runner wave spring being annular, metal and having a plurality of inward-protruding indentations in static, frictional engagement with the cylindrical surface of the first recess and a plurality of outward-protruding indentations in static frictional engagement with the runner bore, the thrust runner wave spring having two ends with a gap between through which the key extends, causing the thrust runner wave spring to rotate in unison with the shaft and with the thrust runner; and wherein the thrust runner wave spring has an initial transverse dimension prior to installation that is greater than a radial dimension from the cylindrical surface of the recess to the runner bore, the thrust runner wave spring being elastically deflectable, such that after installation, the thrust runner wave spring exerts an inward bias force against the shaft and an outward bias force against the runner bore to reduce radial vibration movement of the thrust runner, and wherein the portion of the key passing through the recess has an inner side that is at a distance from the axis not less than a distance from the axis to the cylindrical surface of the recess.

11. The ESP according to claim 10, further comprising:

a threaded connector secured to one end of the housing for connecting one end of the seal section into the ESP, the connector having a connector bore through which the shaft extends;

a bearing bushing non-rotatably and rigidly mounted in the connector bore;

a bearing sleeve having a sleeve bore through which the shaft extends, the sleeve bore having a sleeve bore keyway slot, the key fitting within the sleeve bore keyway slot and the shaft keyway slot to cause the bearing sleeve to rotate with the shaft, the bearing sleeve having an outer diameter in sliding engagement with the bearing bushing;

an annular second recess on the shaft, the second recess having upper and lower shoulders facing and parallel to each other, the upper and lower shoulders of the second recess being joined by an outward-facing cylindrical surface of the second recess;

a bearing sleeve wave spring, the bearing sleeve wave spring being annular, metal and having a plurality of inward-protruding indentations in static, frictional engagement with the cylindrical surface of the second recess and a plurality of outward-protruding indentations in static frictional engagement with the sleeve bore, the bearing sleeve wave spring having two ends with a gap between through which the key extends, causing the bearing sleeve wave spring to rotate in unison with the shaft and with the bearing sleeve; and wherein the bearing sleeve wave spring has an initial radial transverse dimension prior to installation that is greater than a radial dimension from the cylindrical surface of the second recess to the sleeve bore, the bearing sleeve wave spring being elastically deflectable, such that after installation, the bearing sleeve wave spring exerts an inward bias force against the shaft and an outward bias force against the sleeve bore.

12. The ESP according to claim 10, further comprising:

a screw pump having a screw pump bore through which the shaft extends, the screw pump bore having a screw pump bore keyway slot, the key fitting within the screw pump bore keyway slot and the shaft bore keyway slot to cause the screw pump to rotate with the shaft, the screw pump having an outer diameter with a helical passage in close proximity to the base bore;

an annular second recess on the shaft, the second recess having upper and lower shoulders facing and parallel to each other, the upper and lower shoulders of the second recess being joined by an outward-facing cylindrical surface of the second recess;

a screw pump wave spring, the screw pump wave spring being annular, metal and having a plurality of inward-protruding indentations in static, frictional engagement with the cylindrical surface of the second recess and a plurality of outward-protruding indentations in static frictional engagement with the base bore, the screw pump wave spring having two ends with a gap between through which the key extends, causing the screw pump wave spring to rotate in unison with the shaft; and wherein the screw pump wave spring has an initial radial transverse dimension prior to installation that is greater than a radial dimension from the cylindrical surface of the second recess to the base bore, the screw pump wave spring being elastically deflectable, such that after installation, the screw pump wave spring exerts an inward bias force against the shaft and an outward bias force against the base bore.

* * * * *